United States Patent [19]

Womack, Jr.

[11] 4,014,134

[45] Mar. 29, 1977

[54] PLANT PACKAGE

[76] Inventor: W. Victor Womack, Jr., P.O. Box 19091, Houston, Tex. 77024

[22] Filed: Aug. 27, 1975

[21] Appl. No.: 608,185

[52] U.S. Cl. ..... 47/84; 47/79; 47/41 R; 206/45.34; 206/423; 206/461; 229/16 D

[51] Int. Cl.[2] ..... A01G 5/00; A01G 13/00; B65D 85/52; B65D 25/54

[58] Field of Search ..... 47/34.11, 37.3, 38, 47/38.1, 41 R; 206/423, 497, 45.31, 461–471, 45.14, 45.33, 45.34, 491; 229/16 D, 87 P, 87

[56] References Cited

UNITED STATES PATENTS

| | | | |
|---|---|---|---|
| 1,991,478 | 2/1935 | Wedge | 47/37 UX |
| 2,340,373 | 2/1944 | Gardner | 47/34.11 |
| 2,932,384 | 4/1960 | Johnnides | 206/45.33 |
| 3,203,542 | 8/1965 | Lightner et al. | 206/45.31 |
| 3,249,213 | 5/1966 | Palmer | 206/45.31 |
| 3,259,236 | 7/1966 | Cole | 206/423 |
| 3,323,640 | 6/1967 | Kugler | 206/423 X |
| 3,335,850 | 8/1967 | Hertzberg | 206/497 |
| 3,450,256 | 6/1969 | Chandler et al. | 206/461 |
| 3,487,915 | 1/1970 | Scott | 206/461 X |
| 3,592,337 | 7/1971 | Phillips, Jr. | 229/16 D X |
| 3,784,004 | 1/1974 | Meyer | 206/497 X |
| 3,884,410 | 5/1975 | Giesecke | 206/491 X |
| 3,904,029 | 9/1975 | Koltz | 206/45.34 |
| 3,918,583 | 11/1975 | Adams | 206/45.14 X |
| 3,949,868 | 4/1976 | Allen | 206/45.34 |

FOREIGN PATENTS OR APPLICATIONS

| | | | |
|---|---|---|---|
| 1,242,502 | 6/1967 | Germany | 206/461 |
| 1,336,923 | 11/1973 | United Kingdom | 206/461 |
| 986,163 | 3/1965 | United Kingdom | 206/470 |

*Primary Examiner*—Edgar S. Burr
*Assistant Examiner*—Steven A. Bratlie
*Attorney, Agent, or Firm*—Arnold, White & Durkee

[57] ABSTRACT

A generally rectangular card having a transparent member sealingly attached thereto defining an enclosed plant-receiving chamber, and a protector formed from a folded-over portion of the card is disclosed. The transparent member is positioned to provide unimpeded observation of the foliage of a plant in the plant-receiving chamber. An observable vial may be introduced into the plant-receiving chamber to facilitate sustaining a plant until it is removed from the plant-receiving chamber and transplanted.

24 Claims, 9 Drawing Figures

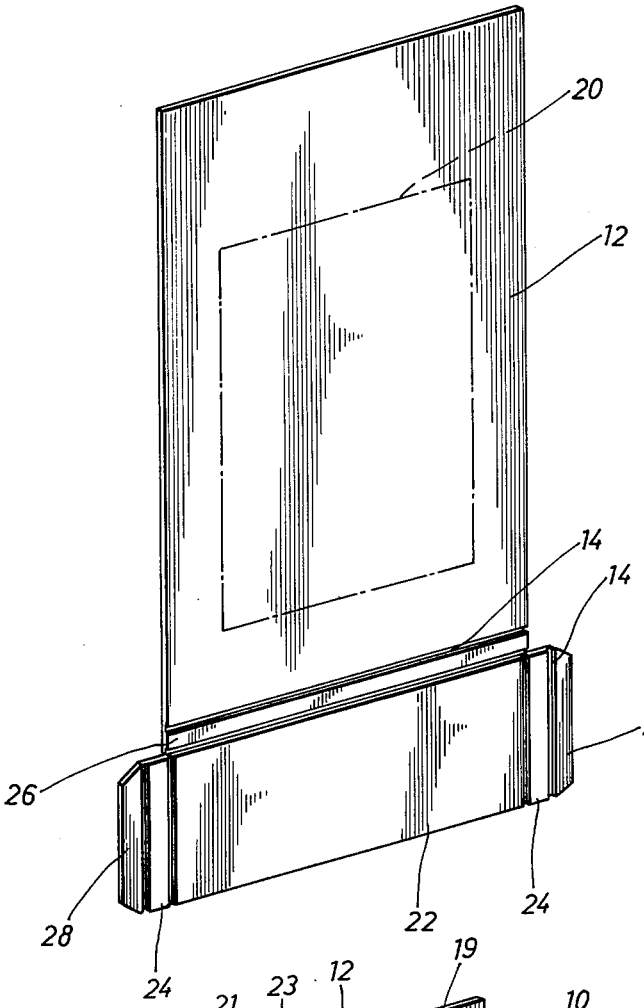
FIG. 1
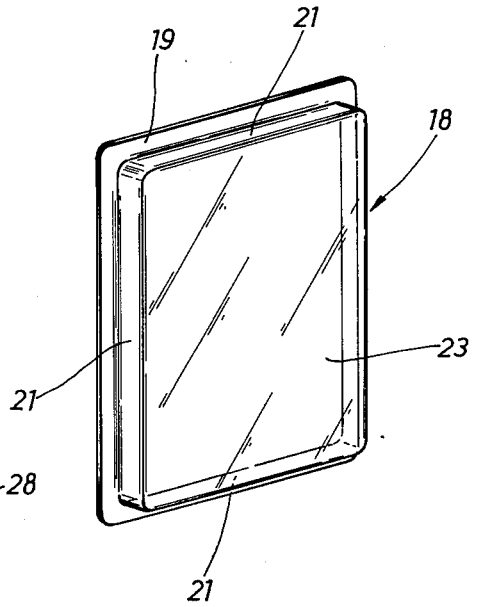
FIG. 2
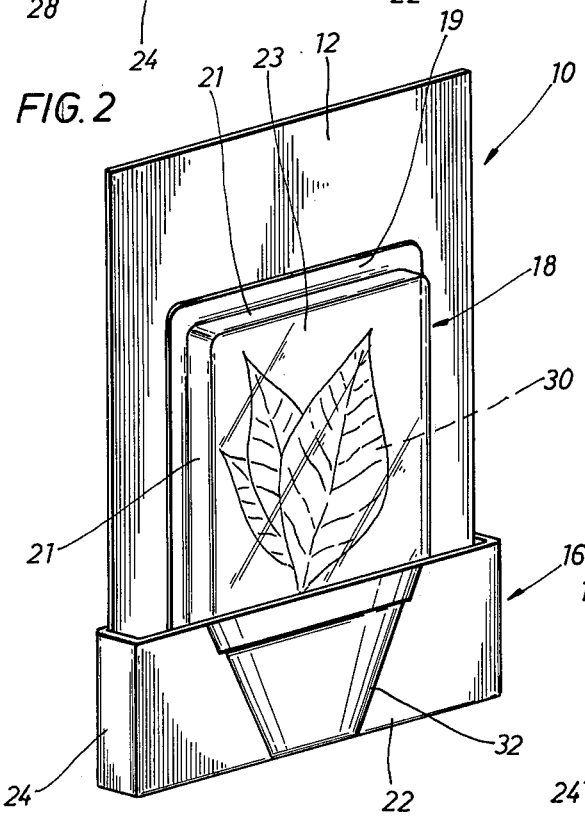
FIG. 3
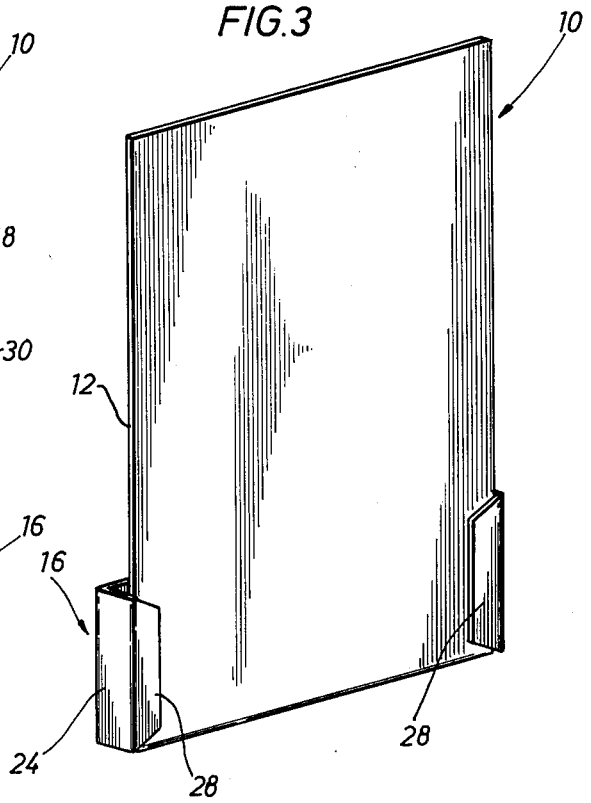

PLANT PACKAGE

BACKGROUND OF INVENTION

The present invention relates to a plant package and particularly to a plant package which will both protect a plant during shipping and further serve as an attractive display at a point of sale.

In the past, attempts have been made to provide a shipping container which could effectively transport a plant embedded in moist earth or humus and which could sustain the plant until it was sold and replanted. Such known packaging arrangements are difficult to ship together in large quantities and have a highly limited shelf life. Many prior art plant packages are easily damaged from moisture or dirt which results in damage to both the plant package and the plant.

Some types of plants, for example, succulents, may be transported without the necessity of embedding the root system in moist earth or humus and the like. In order to transport such plants, the roots are washed clean and are then packaged. The plant is not embedded in soil until after it has been purchased. No satisfactory asthetically appealing packaging arrangement is known for succulents and other types of plants not requiring soil, which provides a functionally satisfactory transportation package suitable for display purposes, which maintains the plant in a healthy condition, and which enables a prospective purchaser to carefully examine the plant prior to purchase. In particular, no plant display package is known which provides the above advantageous characteristics and facilitates shipment both in bulk quantities and individually.

Recognizing the need for an improved plant package, it would, therefore, be desirable to provide an improved plant package which may be economically fabricated and which provides improved economy and utility in packaging, shipping, and displaying of plants, particularly succulent plants and other such similar plants which may be shipped in a washed-root condition.

OBJECTS AND SUMMARY OF A PREFERRED EMBODIMENT OF THE INVENTION

It is, therefore, a general object of the present invention to provide a novel plant package which minimizes or reduces the problems of the type previously noted.

It is a more particular object of the present invention to provide a novel plant package which may be economically and efficiently shipped either in bulk or individually.

It is another object of the present invention to provide a novel plant package which will provide adequate protection for a plant yet permit ready inspection of the plant.

It is yet another object of the present invention to provide a novel plant package which will provide a suitable environment for a plant from the time of packaging to the time of purchase by a consumer, with both economy of materials and a pleasing overall appearance.

It is yet still another object of the present invention to provide a novel plant package suitable for transportation of plants both requiring a source of moisture while packaged and those which may be packaged in a washed-root condition.

A plant package according to a preferred embodiment of the invention intended to substantially accomplish the foregoing objects includes a rectangular card with a transparent member sealingly attached to the card and defining an enclosed plant-receiving chamber. A protector or bumper is formed from a folded over portion of the card for protecting from impact a bottom portion of the transparent member lying thereunder. It is the portion of the plant-receiving chamber carrying the delicate roots of the plant which receives the extra protection afforded by this bumper. A top portion of the transparent member is positioned to provide unimpeded observation of the foliage of the plant in the plant-receiving chamber. If it is desired to maintain the roots of the plant in a moist condition, there may be provided within the plant-receiving chamber a vial into which the roots of the plant may be placed. This vile may carry water, water embedded cotton, moist soil, and the like.

The basic features of this invention have been described in rather broad terms in order that the detailed description thereof that follows may be better understood and in order that the contribution to the art may be better appreciated. There are, of course, additional features of the invention that will be described hereinafter and which will also form the subject of the claims appended hereto.

The objects and advantages of the present invention will become apparent with reference to the following detailed description of a preferred embodiment thereof in connection with the accompanying drawings, wherein like reference numerals have been applied to like elements, in which:

BRIEF DESCRIPTION OF THE DRAWINGS

FIG. 1 is an exploded pictorial view of an embodiment of the present invention prior to assembly;

FIG. 2 is a pictorial view of the elements of FIG. 1 after they have been assembled to package a plant;

FIG. 3 is a back-view of the plant package of FIG. 2;

Figure 4:
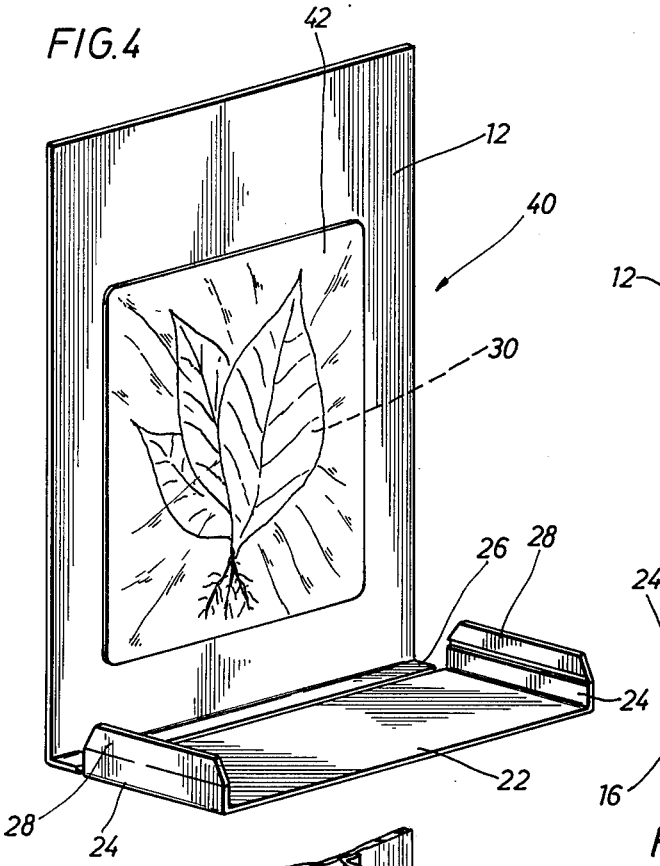
FIG. 4 pictorially depicts an alternative embodiment of the plant package according to the present invention wherein heat shrunk plastic is utilized to define a portion of a plant-receiving chamber, the plant package being shown in a partially assembled condition.

With reference now to the drawings, with particular reference to FIGS. 1–3, there may be seen a plant package or display card 10 according to a preferred embodiment of the present invention. The plant package 10 comprises a substantially rectangular cardboard base portion or panel 12 having a plurality of scored lines 14 to facilitate the folding of the cardboard to form a pocket 16 as shown in the drawings. This base panel 12 may be fabricated from cardboard suitable for printing.

A transparent member 18, which may be molded plastic, is attached to the base panel 12 by conventional means. The transparent member 18 and a portion 20 of the base panel 12 define a plant-receiving chamber. The base panel 12 may be treated with a fluid impervious material such as plastic in order to provide a substantially air-tight plant-receiving chamber when the transparent member 18 is, say, glued or heat sealed to the base panel 12.

The transparent member 18 comprises a flange 19 which is attachable to the base panel 12. Four side walls 21 are integrally formed with the transparent member for supporting a main viewing window 23 through which the foliage of a plant may be observed substantially unimpeded. The four upstanding side walls 21 additionally serve to resist crushing of the plant.

The pocket 16 formed by folded-over portions of the base panel 12 comprises a small front panel 22, a pair of side walls 24, a bottom wall 26 and a pair of fastening ears 28. As may be seen in the drawings, the edges of the side walls 24 are attached to the front panel 22 and the base panel 12, and the edges of the bottom wall 26 are attached to the bottom of the bottom panel 22 and the bottom of the base panel 12. The fastening ears 28 may be glued to a back side of the panel 12. As noted above, the front panel 22 is operable as a protector or bumper for a portion of the transparent member 18 lying thereunder.

Preferably, a plant 30 packaged within the plant-receiving chamber will have its roots covered by the front panel 22 with an upper portion of the transparent member 18 providing substantially unimpeded observation of the foliage of the plant. There may be imprinted on the small panel 22 a flower pot 32 in order to simulate the appearance of the plant embedded in soil in such a flower pot.

It has been found that the small panel 22 functions to minimize a crushing of the plant 30, particularly of the delicate roots of the plant when the plant is in the package. In addition, it has been found that plant packages according to this embodiment of the invention may be placed front-to-back in larger boxes to facilitate packaging of large quantities of plants with little or no damage to the plants.

Thus, it will be appreciated, that a portion of the transparent member 18 is situated within the pocket 16 and is afforded additional protection by the small panel 22 lying thereover. It is preferred that the transparent member lie inside a boundary defined by the pocket in order that a plurality of plant packages according to this embodiment of the invention may be placed front-to-back in larger containers without placing undesirable pressure on the viewing window 23.

Figure 5:
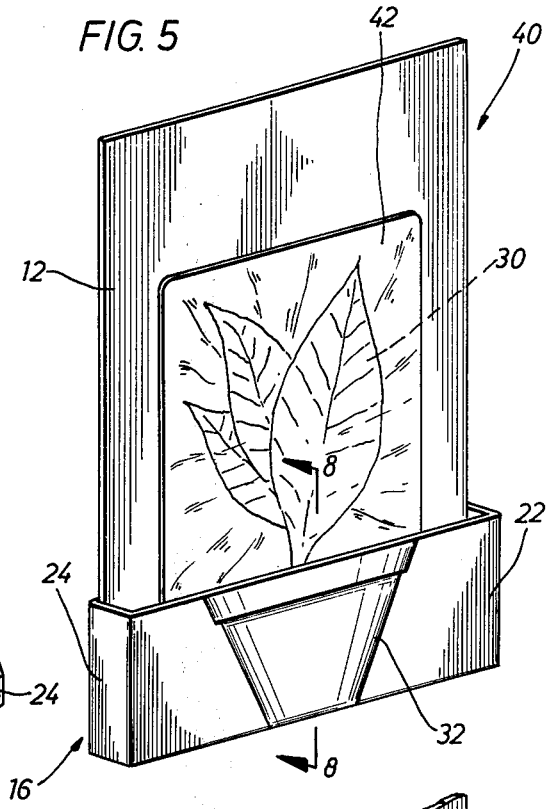
FIG. 5 is the plant package of FIG. 4 after assembly has been completed.
Figure 8:
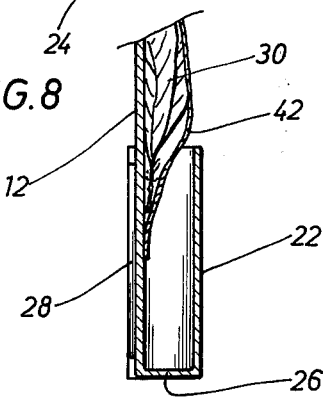
FIG. 8 is a partial longitudinal sectional view taken through section lines 8—8 in FIG. 5.

With particular reference now to FIGS. 4, 5 and 8, there may be seen an alternative embodiment 40 of the present invention. In this embodiment 40, instead of utilizing a molded transparent member 18 having the same geometry for every plant, a flexible plastic material 42 is placed over the plant. This material conforms to the contours of the particular plant being packaged and is attached to the base panel 12 to define a substantially air-tight plant-receiving chamber as in the case of the embodiment shown in FIGS. 1–3. This plastic 42 may be heat shrunk as depicted in FIGS. 4, 5, and 8 to hold the plant 30 close to the portion of the base panel underlying the transparent member and to reduce the volume of air in the plant-receiving chamber. For some species of plants, this may result in improved packaging in that the reduced volume of air in the plant-receiving chamber enables the plant to maintain its natural moisture over a greater period of time. That is, reduced evaporation of plant moisture is available by use of this embodiment of the invention.

As in the case of the embodiment depicted in FIGS. 1–3, a protective pocket or bumper 16 may be formed by a folded over portion of the rectangular base 12. Scoring 14 may be provided to facilitate proper assembly of the plant package and in order to attribute to the package greater strength characteristics.

Figure 6:
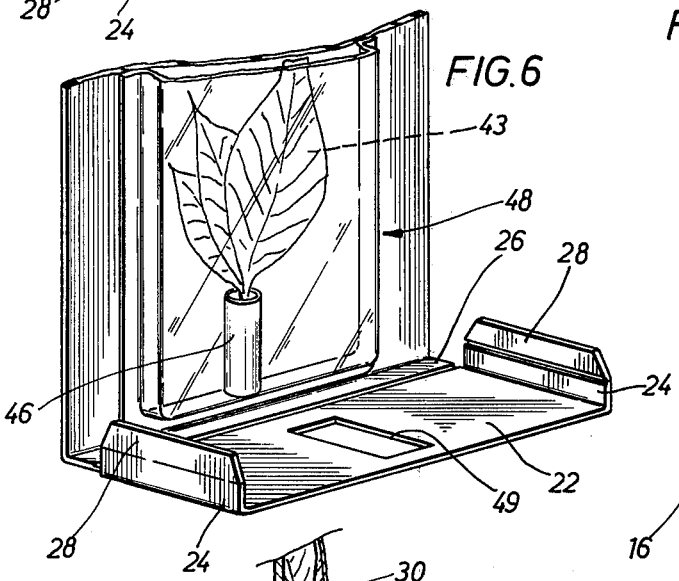
FIG. 6 is a pictorial partial-sectional view of an embodiment of the plant package according to the present invention wherein a vial has been positioned within a plant-receiving chamber, and the roots of the plant have been embedded in the vial, the plant package being shown in a partially assembled condition.
Figure 7:
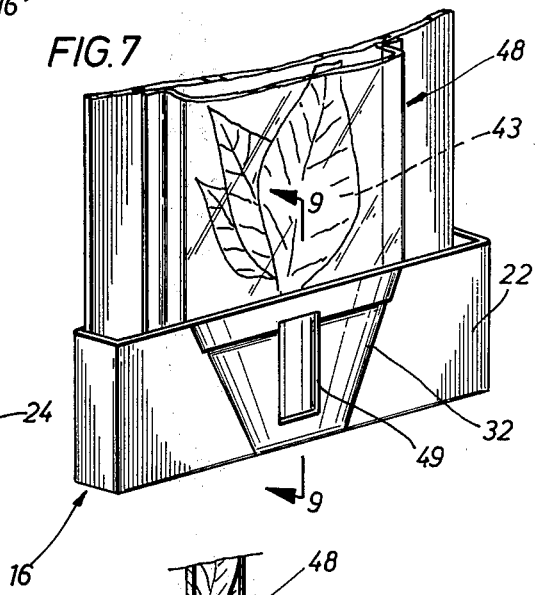
FIG. 7 is a pictorial partial-sectional view of the assembled plant package of FIG. 6.
Figure 9:
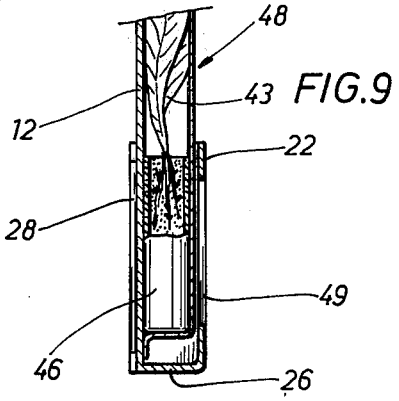
FIG. 9 is a partial longitudinal sectional view taken through section lines 9—9 in FIG. 7.

In some instances it may be desirable to provide an additional source of moisture or nourishment to a plant 43 undergoing shipment (see FIGS. 6, 7, and 9). In such instances, the roots of the plant 43 may be inserted into a small vial 46 which may contain, say, moist cotton or humus. In such cases, the vial 46 may be attached to the rectangular base 12 either prior to or subsequent to insertion of the roots of the plant. In any event, in accordance with the present invention, such a vial 46 would lie within a plant-receiving chamber defined by a transparent member 48 and a portion of the rectangular base panel 12. It will, of course, be appreciated that a transparent member comprised of either molded plastic or heat-shrunk flexible plastic may be utilized in connection with the vial. In this embodiment of the invention, it is preferable that the vial lie inside the transparent member 48 and that the transparent member lie within the boundaries of the pocket 16.

In instances where the vial 46 is utilized, it may be desirable to provide a slot 49 in the small front panel 22 to permit observation of the contents of the vial 46 or of the roots of the plant. For example, it may be desirable to observe whether cotton in the vial is moist.

In addition, it may be useful to observe the roots of the plant 43, regardless of whether or not a vial is utilized, and in such instances a slot 49 may be provided in the small panel 22. This slot 49 does not substantially inhibit the compression resistance qualities of the small panel 22.

It will of course be appreciated that the size of the transparent members 18, 42 or 48 may be modified in accordance with the size of the particular plant being packaged. Also, portions of the base panel 12 may be utilized for advertising and/or directions for care and feeding of the plant carried thereby.

It has been found particularly advantageous to imprint the flower pot 32 on the small panel 22, which attributes an extremely pleasing appearance to the plant and simulates the appearance of the plant embedded in such a pot.

Whereas the disclosed embodiments of the present invention have been found particularly useful in the packaging and transportation of succulents, the invention is not intended to be so limited. In particular, it is anticipated that a variety of species of plants, whether or not transported with washed roots, may be successfully packaged in accordance with the present invention.

SUMMARY OF ADVANTAGES AND SCOPE OF THE INVENTION

It will be appreciated that in constructing a plant package according to the present invention, certain significant advantages are provided.

In particular, the air-tight plant-receiving chamber defined by the elements of the present invention provides a most satisfactory environment for the shipment of washed-root succulents, either through the mail individually or packaged in large quantity. The plant packages of the present invention serve not only to sustain the plant, but also to enhance the marketing appeal of the plant. There is provided a conveniently transported and aesthetically appealing package that not only permits a consumer to carefully inspect the foliage of the plant (and in some instances the root system of the plant) but also to conceptualize the appearance of a plant after purchase.

The invention is adaptable to plants requiring moisture and/or humus or soil for shipment in that a vial may be included in the plant-receiving chamber. The air-tight plant-receiving chamber serves to minimize moisture loss during shipment and storage of the plant and provides a closed environment which can be modified by modifying the conditions under which the plants are packaged. For example, additional moisture may be introduced into the plant-receiving chamber during packaging.

Further modifications and alternative embodiments of the apparatus of this invention will be apparent to those skilled in the art in view of this description. Accordingly, this description is to be construed as illustrative only and is for the purpose of teaching those skilled in the art the manner of carrying out the invention. It is to be understood that the forms of the invention herewith shown and described are to be taken as the presently preferred embodiments. Various changes may be made in the shape, size and arrangement of the parts. For example, equivalent materials may be substituted for that of the base panel and transparent member, parts may be reversed, and certain features of the invention may be utilized independently of the use of other features, all as would be apparent to ones skilled in the art after having the benefit of this description of the invention. Accordingly, it is intended that all such alternatives, modifications and variations which fall within the spirit and scope of the invention as defined in the appended claims be embraced thereby.

What is claimed is:

1. A fluid tight plant package comprising:

a. a substantially rectangular, fluid impervious base panel having a width dimension;

b. a front panel substantially smaller in height than said base panel, said front panel being defined by a first portion of said base panel folded over along said width dimension, said front panel and a portion of said base panel defining a four-sided pocket which is closed along three sides and open along a fourth side; and c. a transparent member attached only to a second portion, other than said first portion of said base panel, in a fluid tight relationship to define a plant-receiving chamber having upper and lower regions, said front panel extending in front of a portion of said transparent member to thereby place said lower region within said pocket, wherein said smaller front panel defines a protector for said lower region, and said upper region provides unimpeded observation of a portion of a plant in said plant-receiving chamber.

2. The plant package according to claim 2 wherein said transparent member is preformed plastic.

3. The plant package according to claim 2 wherein said transparent member is a flexible sheet which is heat shrunk over a plant positioned on said base panel.

4. The plant package according to claim 2 and further including a vial positioned in said lower region and wherein an opening is provided in said front panel to enable observation of said vial through said transparent member.

5. The plant package according to claim 1 and including side panels foldably extending from said front panel and attached to said second portion of said base panel, said pocket being defined by said front, side, and second portion of said base panels.

6. The plant package according to claim 1 wherein said open side has a length equal to said width dimension.

7. An airtight package for a living plant comprising:

a. a foldable member having at least one score to define therein substantially rectangularly shaped base having a width dimension, the front panel being substantially smaller in length than the base panel, and folded over and secured to the base panel for forming a four-sided pocket of the same said width dimension therewith which is closed on three sides and open on the side opposite said score, said open side having a length substantially equal to said width dimension; and b. a transparent member sealed to only said base panel to form therewith an airtight, plant-receiving chamber having upper and lower regions, the lower region disposed within the open side of said pocket for protection behind said front panel, wherein said upper region provides unimpeded observation of a plant disposed in said chamber.

8. The package according to claim 7 wherein said foldable member also includes scores to define a pair of side panels which adjoin said front panel and a bottom panel between said front and base panels, said bottom and side panels secured to said base panel to thereby further define said pocket.

9. The package according to claim 7 wherein said base panel and said front panel lie substantially in planes which define a protective zone therebetween, and wherein said transparent member is wholly disposed within said zone.

10. The package according to claim 7 wherein said base and front panels lie substantially in parallel planes which define a protective zone therebetween, and wherein said transparent member is wholly disposed within said protective zone.

11. The package according to claim 7 and further including a vial disposed within said lower region for providing moisture to a plant disposed within said chamber.

12. The package according to claim 11 and further including an opening in said front panel to thereby allow viewing of said vial.

13. The package according to claim 7 wherein said transparent member is preformed plastic.

14. The package according to claim 7 wherein said transparent member is a flexible sheet which is heat shrunk over a plant positioned on said base panel.

15. A plant package adapted to be stacked in a front-to-back relationship with adjacent such packages comprising:

a. a substantially rectangular, fluid impervious base panel having length and width dimensions;

b. a front panel substantially smaller in height than said base panel and which is attached to said base panel for defining a plane relative thereto, said front panel being a folded-over portion of said base panel and defining a four-sided pocket therewith which is closed on three sides and open along a fourth side;

c. a substantially transparent member sealingly attached only to the non-folded over portion of said base panel to define a substantially airtight plant-receiving chamber having upper and lower regions, said lower region extending into said pocket; and d. said transparent member lying entirely within a zone defined by said base panel and said plane, said pocket defining a protective zone for said lower region and to limit the proximity of adjacent base panels of said plant packages.

16. The plant package according to claim 15 wherein said transparent member comprises preformed plastic.

17. The plant package according to claim 15 wherein said transparent member comprises a flexible sheet which is heat shrunk over a plant positioned on said panel.

18. The plant package according to claim 15 and further comprising a vial positioned in said lower region and wherein an opening is provided in said front panel to enable observation of said vial through said transparent member.

19. The plant package according to claim 15 wherein said open fourth side has a length substantially equal to said width dimension.

20. An airtight plant package comprising:

a. a substantially rectangular, fluid impervious base panel;

b. a substantially smaller in length, rectangular front panel positioned in a plane generally parallel to said base panel;

c. a bottom panel for connecting together a bottom edge of said base panel and a bottom edge of said front panel;

d. a pair of side panels positioned to connect a pair of side edges of said front panel to a portion of a pair of side edges of said base panel, said front panel and said bottom panel being formed by folded-over portions of said base panel, and said side panels foldably extending from said front panel, wherein said front panel, said bottom panel, and said pair of side panels define with the non-folded over portion of said base panel a four-sided pocket having three closed sides and an open side; and e. a substantially transparent member sealingly attached to only the non-folded over portion of said base panel to define an airtight plant-receiving chamber, a lower portion of said transparent member extending into said pocket, said pocket defining a protective zone for said lower portion of said transparent member extending into the pocket.

21. The plant package according to claim 20 wherein said transparent member is preformed plastic.

22. The plant package according to claim 20 wherein said transparent member is a flexible sheet which is heat shrunk over a plant positioned on said card.

23. The plant package according to claim 20 and further comprising a vial positioned in said portion of the plant receiving chamber extending into said pocket and wherein an opening is provided in said front panel to enable observation of said vial through said transparent member.

24. The plant package according to claim 20 wherein said front panel has a width dimension, and wherein said open side has a dimension substantially equal to said width dimension.

* * * * *

UNITED STATES PATENT OFFICE

CERTIFICATE OF CORRECTION

Patent No. 4,014,134 Dated March 29, 1977

Inventor(s) W. Victor Womack, Jr.

It is certified that error appears in the above-identified patent and that said Letters Patent are hereby corrected as shown below:

Column 5, lines 62, 64 and 67, the claim reference numeral "2", each occurrence, should read --1--.

Signed and Sealed this

*Thirteenth* Day of *September 1977*

[SEAL]

*Attest:*

RUTH C. MASON
*Attesting Officer*

LUTRELLE F. PARKER
*Acting Commissioner of Patents and Trademarks*